US010137330B1

(12) United States Patent
Xu

(10) Patent No.: US 10,137,330 B1
(45) Date of Patent: Nov. 27, 2018

(54) SIX-WEBBED GLOVE

(71) Applicant: Cui-Xuan Xu, New Taipei (TW)

(72) Inventor: Cui-Xuan Xu, New Taipei (TW)

( * ) Notice: Subject to any disclaimer, the term of this patent is extended or adjusted under 35 U.S.C. 154(b) by 0 days.

(21) Appl. No.: 15/980,883

(22) Filed: May 16, 2018

(51) Int. Cl.
*A63B 31/04* (2006.01)

(52) U.S. Cl.
CPC ..... *A63B 31/04* (2013.01); *A63B 2208/03* (2013.01)

(58) Field of Classification Search
CPC ..... A63B 31/04; A63B 2208/03
See application file for complete search history.

(56) References Cited

U.S. PATENT DOCUMENTS 3,938,207 A * 2/1976 Drescher ..... A63B 31/04 441/57
4,669,991 A * 6/1987 Southworth ..... A63B 31/04 441/57
4,746,313 A * 5/1988 Bray ..... A63B 31/04 441/57
4,832,643 A * 5/1989 Schoofs ..... A63B 31/04 441/56
4,892,496 A * 1/1990 Vondruska ..... A63B 31/04 441/55
4,913,418 A * 4/1990 Schlueter ..... A63B 31/04 434/254
4,923,418 A * 5/1990 Hoffman ..... A63B 21/065 441/57
5,312,278 A * 5/1994 Jen ..... A63B 31/04 441/57
5,356,322 A * 10/1994 Bakalis ..... A63B 31/04 441/57
5,468,200 A * 11/1995 Hoffman ..... A63B 21/065 482/105
5,511,998 A * 4/1996 Johnson ..... A63B 31/10 441/56
5,641,316 A * 6/1997 Bakalis ..... A63B 31/04 441/57
5,842,896 A * 12/1998 Liveoak ..... A63B 31/10 441/56
6,019,650 A * 2/2000 Rives ..... A63B 31/10 441/56
6,745,403 B2 * 6/2004 Sajovic ..... A41D 19/01547 2/161.1
6,772,441 B2 * 8/2004 Lucas, Jr. ..... A41D 19/01582 2/161.1

(Continued)

*Primary Examiner* — Lars A Olson
*Assistant Examiner* — Jovon E Hayes
(74) *Attorney, Agent, or Firm* — Alan D. Kamrath; Kamrath IP Lawfirm, P.A.

(57) ABSTRACT

A six-webbed glove has a main body, four middle webs, two outer webs, two finger-supporting boards and an arm-supporting board. The main body has a palm segment, five finger segments and an arm segment. The finger segments and the arm segment are mounted on two opposite ends of the main body. The middle webs are respectively mounted between every two adjacent finger segments. The two outer webs are mounted on two opposite sides of the main body and connected to the palm segment and the arm segment along a contour of the main body. The finger-supporting boards and the arm-supporting board are respectively mounted inside the finger segments and the arm segment, and are capable of maintaining the shape of the finger segments and the arm segment.

12 Claims, 5 Drawing Sheets

(56) References Cited

U.S. PATENT DOCUMENTS

| | | | | |
|---|---|---|---|---|
| 7,578,714 | B2 * | 8/2009 | MacKay | A63B 31/04 2/158 |
| 8,790,224 | B1 * | 7/2014 | Davis | A63B 21/0084 441/50 |
| 8,813,302 | B1 * | 8/2014 | Capito | A47L 13/18 15/227 |
| 2012/0017352 | A1 * | 1/2012 | Waddell | A63B 47/001 2/161.1 |
| 2016/0107034 | A1 * | 4/2016 | Shaytan | A63B 31/02 482/55 |

* cited by examiner

SIX-WEBBED GLOVE

BACKGROUND OF THE INVENTION

1. Field of the Invention

The present invention relates to an underwater glove, especially to a swimming glove with webs.

2. Description of the Prior Arts

With reference to FIG. 5, a conventional swimming glove 91 has multiple web surfaces 93 respectively disposed between every two adjacent finger portions 92. The web surfaces 93 may increase a surface area of a swimmer's hand, so when the swimmer is moving forwardly under the water by pushing the water backwardly, the increased area of the contacting surface between the swimming glove and water can increase the moving speed of the swimmer.

However, the web surfaces 93 of the conventional swimming glove 91 are only disposed at the intervals between every two adjacent finger portions 92. In other words, for a normal five-finger glove, there are only four web surfaces 93, therefore the improvement of the moving speed of the swimmer is still insufficient. So, the efficiency for using the conventional swimming glove 91 is poor.

To overcome the shortcomings, the present invention provides a six-webbed glove to mitigate or obviate the aforementioned problems.

SUMMARY OF THE INVENTION

The main objective of the present invention is to provide a six-webbed glove that further has two outer webs between the outermost finger segments and the arm segment, so the swimming efficiency of the six-webbed glove is greatly improved.

The six-webbed glove has a main body, four middle webs, two outer webs, two finger-supporting boards, and an arm-supporting board.

The main body has a palm segment, five finger segments, and an arm segment. Two opposite ends of the palm segment are respectively a finger end and an arm end. The five finger segments are disposed on the finger end of the palm segment, are arranged apart from each other along a horizontal direction, and communicate with the palm segment. The five finger segments can also be divided into three inner finger segments and two outer finger segments. The three inner finger segments are disposed between the two outer finger segments. The arm segment is disposed on the arm end of the palm segment and communicates with the palm segment. The arm segment has a wearing opening formed on an end of the arm segment away from the palm segment.

The four middle webs are respectively disposed between every two adjacent finger segments and each middle web fills up a gap between said two finger segments.

The two outer webs are respectively disposed on two opposite sides of the main body and respectively connected to the two outer finger segments. One of two ends of each one of the two outer webs is connected to an end of the corresponding outer finger segment, and said outer web is also connected to the corresponding outer finger segment, the palm segment, and the arm segment along a contour of the corresponding side of the main body.

The two finger-supporting boards are respectively mounted inside the two outer finger segments. Each one of the two finger-supporting boards extends to the end of the corresponding outer finger segment.

The arm-supporting board is mounted inside the arm segment.

Given the forgoing structure of the six-webbed glove, by further comprising two outer webs respectively disposed on two opposite sides of the main body, the present invention may greatly increase the overall contact area between the webs on the main body and the water, compared to the conventional swimming glove. Specifically, the conventional swimming glove only comprises webs between the gaps between every two adjacent finger portions, meaning that there are no webs on two opposite sides of the conventional swimming glove. Therefore, when a user is swimming underwater wearing the present invention, the moving efficiency is enhanced.

Moreover, the two finger-supporting boards and the arm-supporting board may ensure the main body, especially the middle webs and the outer webs, which are all made of soft materials, is properly and thoroughly unfolded when used, so the contact area between the present invention and the water may be greatly increased during use.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
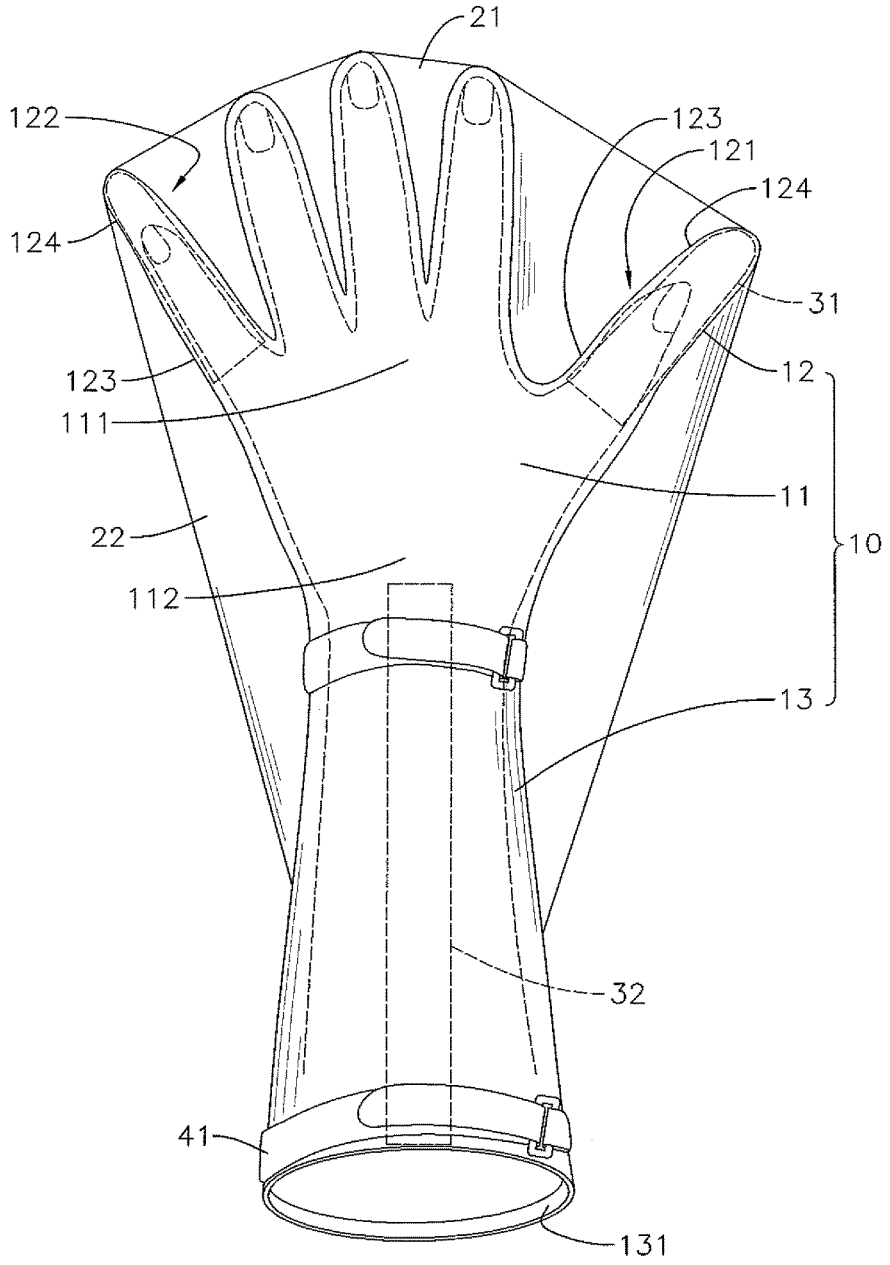
FIG. 1 is a top view of a six-webbed glove in accordance with the present invention.

With reference to FIG. 1, a six-webbed glove in accordance with the present invention comprises a main body 10, four middle webs 21, two outer webs 22, two finger-supporting boards 31, one arm-supporting board 32, and at least one fixing unit 41.

The main body 10 comprises a palm segment 11, five finger segments 12, and an arm segment 13.

Two opposite ends of the palm segment 11 are respectively a finger end 111 and an arm end 112.

The five finger segments 12 are mounted on the finger end 111 of the palm segment 11, are arranged apart from each other, and communicate with the palm segment 11. The five finger segments 12 also can be divided into two outer finger segments 121 and three inner finger segments 122. The inner finger segments 122 are disposed between the two outer finger segments 121. Specifically, because the glove in the present invention is designed for a human hand, the five finger segments 12 resemble the five fingers of a human hand. Therefore, in the present embodiment, the two outer finger segments 121 of the five finger segments 12 are respectively for a thumb and a little finger.

In the present embodiment, each of the outer finger segments 121 comprises a finger-fit portion 1211 and an extended portion 1212. Two opposite ends of each finger-fit portion 1211 are respectively connected to the corresponding extended portion 1212 and the palm segment 11. But a length and a structure of the outer finger segment 121 are not limited thereto. It may be adjusted according to the user's need. Furthermore, the remaining three inner finger segments 122, respectively corresponding to an index finger, a middle finger, and a ring finger of a human hand, may also each respectively comprise a finger-fit portion and an extended portion.

In the present embodiment, a length of each finger-fit portion 1211 is to resemble a normal length of a corresponding human finger. Therefore when a user is to wear the present invention, his/her finger will be disposed inside the corresponding finger-fit portion 1211. On the other hand, the extended portion 1212 further extends from one end of said finger-fit portion 1211. The extended portion 1212 is to extend the overall length of each finger segment 12.

The arm segment 13 is connected to and communicates with the arm end 112 of the palm segment 11. A wearing opening 131 is formed on an end of the arm segment 13 that is away from the palm segment 11. The user may wear the present invention on his/her hand through the wearing opening 131.

Figure 2:
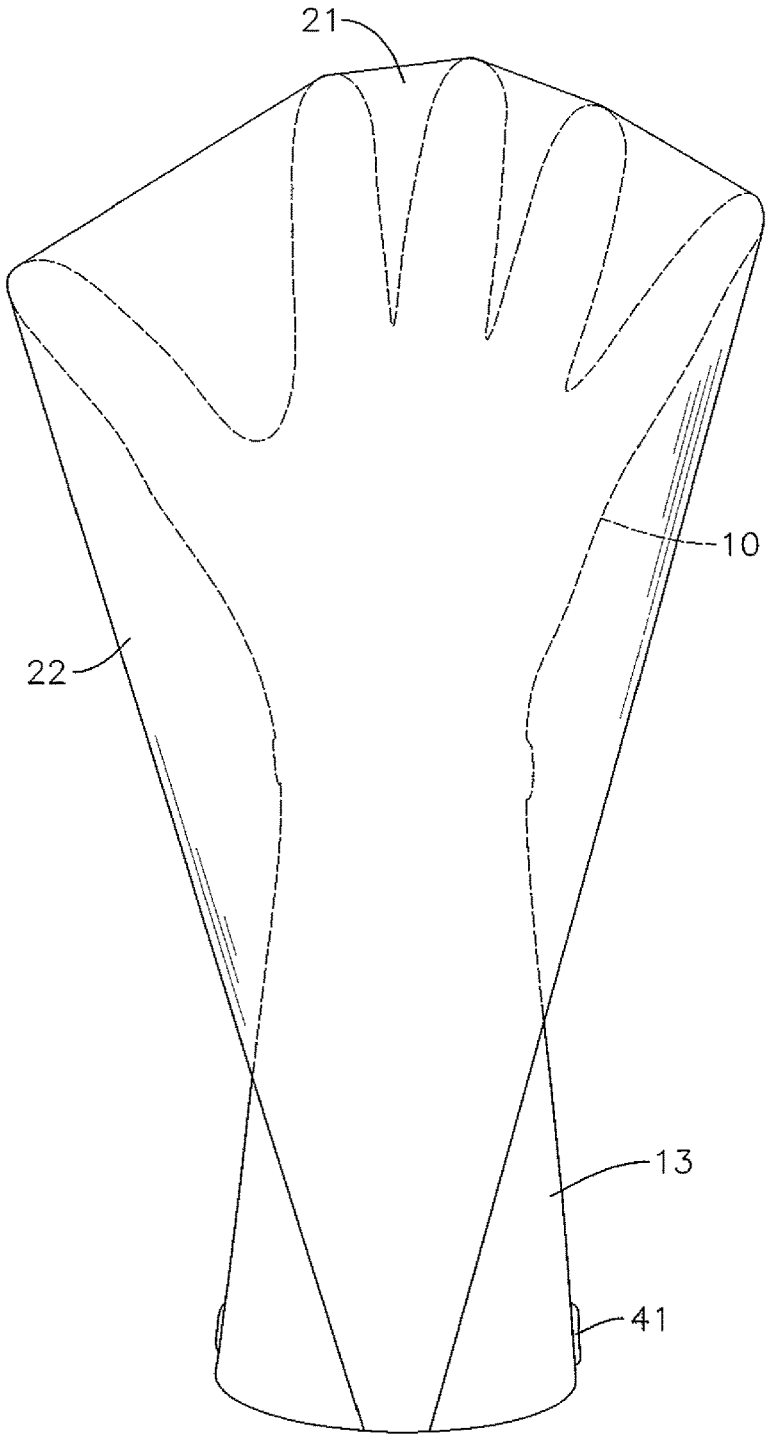
FIG. 2 is a bottom view of the six-webbed glove in FIG. 1.

With reference to FIGS. 1 and 2, the middle webs 21 are respectively mounted between every two adjacent said finger segments 12 and each middle web 21 fills up a gap between said two adjacent finger segments 12.

Furthermore, because a number of the finger segments 12 in the present invention is five, a total number of the gaps between every two adjacent finger segments 12 is four, which means a number of the middle webs 21 is also four. However, a number and a disposition of the middle webs 12 are not limited thereto, as it can be adjusted by the need of the user.

The two outer webs 22 are respectively mounted on two opposite sides of the main body 10, and are respectively connected to the two outer finger segments 121. One of two ends of each one of the two outer webs 22 is connected to an end of the corresponding outer finger segment 121. The other end of said outer web 22 is connected to a side of the arm segment 13. Said outer web 22 is connected to the corresponding outer finger segment 121, the palm segment 11, and the arm segment 13 along a contour of the corresponding side of the main body 10.

By connecting from the finger segment 12 to the arm segment 13, each outer web 22 forms a large web surface on one side of the main body 10.

Furthermore, in the present embodiment, the two outer webs 22 are integrated with the aforementioned middle webs 21, as shown in FIG. 2. However, it is not limited thereto, as the outer webs 22 and the middle webs 21 may also be arranged apart from each other.

Besides, in the present embodiment, for each outer web 22, the end of said outer web 22 that is connected to the arm segment 13 is arranged apart from the wearing opening 131 of the arm segment 13, but it is not limited thereto. Said end may also be extended to the wearing opening 131.

Figure 4:
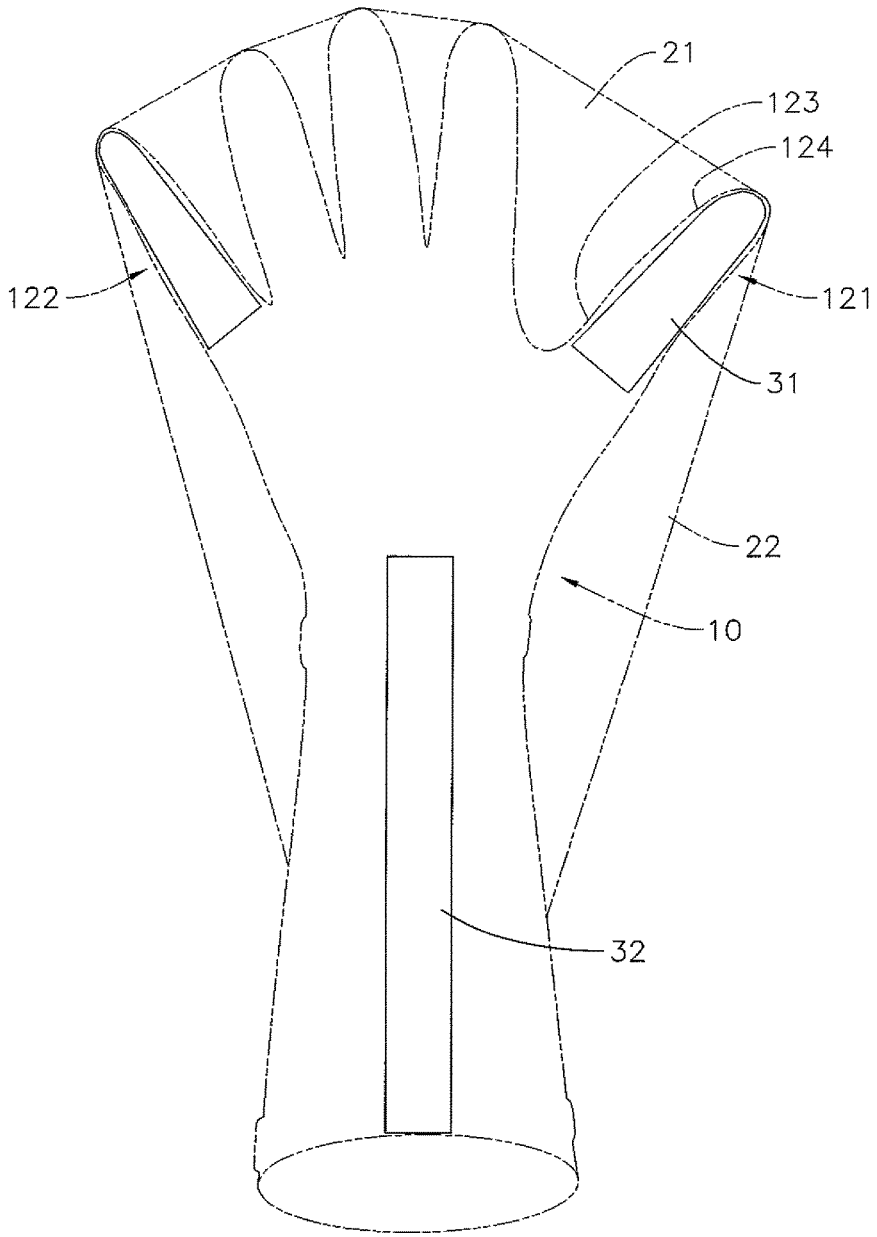
FIG. 4 is a schematic view of the relative position between the finger-supporting boards and the arm-supporting board.
Figure 5:
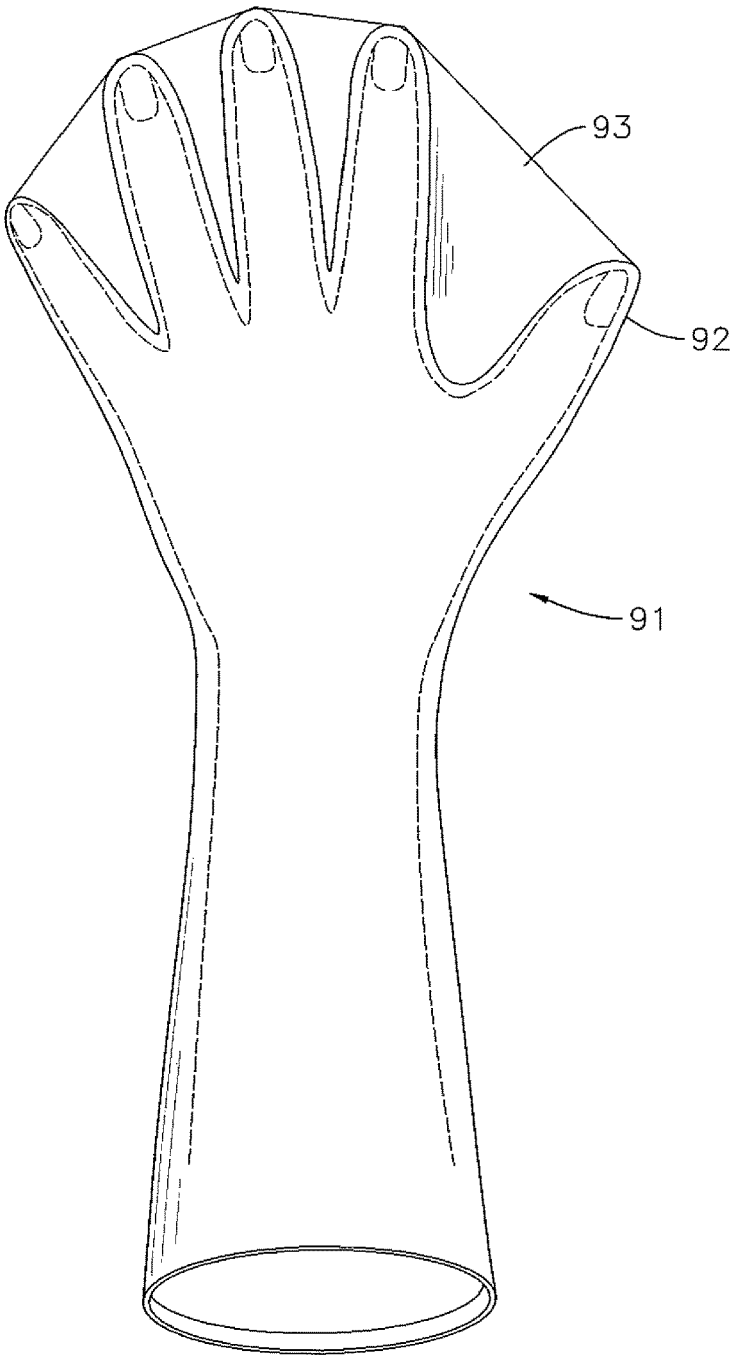
FIG. 5 PRIOR ART
FIG. 5 is a top view of a conventional swimming glove.

With reference to FIGS. 1 and 4, the two finger-supporting boards 31 are respectively mounted inside the two outer finger segments 121. Each finger-supporting board 31 extends to an end of the corresponding outer finger segment 121. Specifically, in the present embodiment, each outer finger segment 121 comprises the finger-fit portion 1211 and the extended portion 1212, therefore in the present embodiment, each finger-supporting board 31 is mounted in the extended portion 1212 of the corresponding outer finger segment 121. Moreover, a length of the finger-supporting board 31 is longer than or equal to a length of the corresponding extended portion 1212. So the finger of the user can move the extended portion 1212 via the finger-supporting board 31, and the extended portion 1212 can increase the contacting area. Precisely, in the present embodiment, the length of each finger-supporting board 31 is longer than or equal to a total length of the corresponding extended portion 1212 and the finger-fit portion 1211. That is, the length of each finger-supporting board 31 is longer than or equal to the length of the corresponding finger segment 12.

Figure 3:
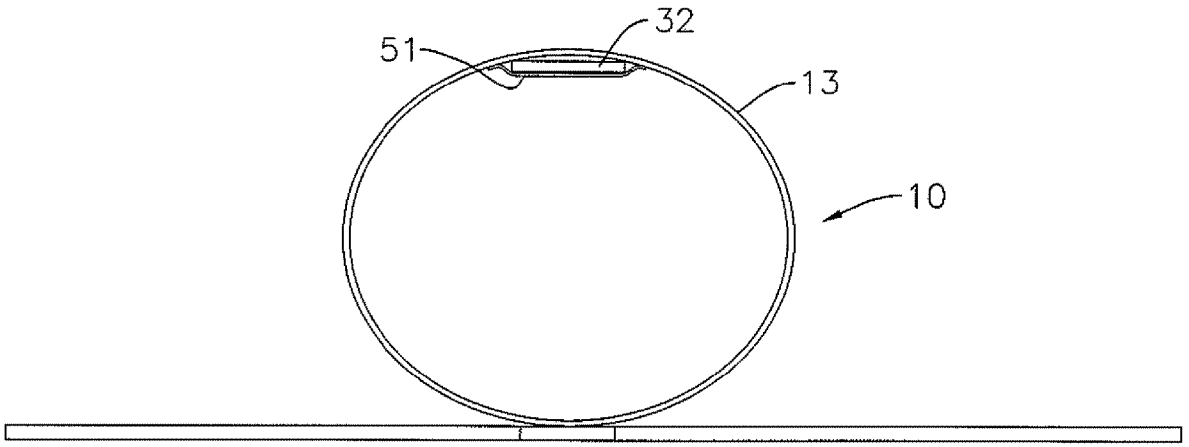
FIG. 3 is a cross sectional and enlarged view of the arm segment from the six-webbed glove in FIG. 1.

With reference to FIGS. 1, 3, and 4, the arm-supporting board 32 is mounted inside the arm segment 13. An end of the arm-supporting board 32 that is adjacent to the wearing opening 131 at an interval from the wearing opening 131. In the present embodiment, a distance between the outer web 22 and the wearing opening 131 is larger than or equal to a distance between the am-supporting board 32 and the wearing opening 131. In other words, the distance between the arm-supporting board 32 and the wearing opening 131 is shorter than a distance between each outer web 22 and the wearing opening 131.

In the present embodiment, the arm-supporting board 32 extends from a portion of the arm segment 13 on which the wearing opening 131 is formed to a connecting position between the arm segment 13 and the palm segment 11. However, it is not limited thereto, as the length of the arm-supporting board 32 may be adjusted if needed.

With reference to FIGS. 3 and 4, in the present embodiment, the finger-supporting boards 31 and the arm-supporting board 32 are all respectively disposed inside the main body 10 by being mounted inside an inner bag 51, which is then sewed inside the main body 10. However, the disposing method is not limited thereto, as the boards 31, 32 can be disposed inside the main body 10 by other means.

With reference to FIG. 1, in the present embodiment, a number of the at least one fixing unit 41 is two, and the two fixing units 41 are both mounted on the arm segment 13 and are arranged apart from each other. The function of the fixing units 41 is to fasten the arm segment 13.

In the present embodiment, each fixing unit 41 is, but not limited to, a tying belt. The form of the fixing units 41 can be different from belts.

The advantages of the present invention are as follows.

First, with reference to FIGS. 1 and 2, by putting the hand into the present invention through the wearing opening 131, the user may wear the present invention into the water and start swimming. The two enlarged outer webs 22 greatly increase the contacting area between the present invention and the water when the user tries to move forward by pushing the water behind the user. Therefore the present invention may increase the swimming speed of the user and lower down the difficulty of swimming.

Second, with reference to FIGS. 1, 3, and 4, the finger-supporting boards 31 and the arm-supporting board 32 may be used as a framework of the present invention.

Specifically, because the main body 10 is normally made of waterproof soft materials, when the present invention is in use and the user's fingers are not long enough to reach the ends of corresponding finger segments 12, a portion of said finger segments that are not supported by the user's fingers can be easily curled, which may be disturbing for the user while swimming. More importantly, if the curled finger segment 12 is the outer finger segment 121 (for the thumb or little finger), the outer webs 22 may not be properly unfolded.

The same issue due to the softness may also occur in the arm segment 13. For example, if the arm segment 13 is curled due to any reason during use, the curled portion of the arm segment 13 may also cause discomfort of the user.

As aforementioned, if any one of the outer finger segments 121 or the arm segment 13 is curled, the two outer webs 22 may not be unfolded properly, which may therefore affect the efficiency of the present invention.

However, the two aforementioned issues may be prevented if the boards 31, 32 are mounted on the outer finger segments 121 and the arm segment 13 respectively. The boards 31, 32 may hold and sustain the shape and structure of the portions on which they are mounted. Therefore, with the support, from the boards 31, 32, it can be ensured that the two outer webs 22 are unfolded thoroughly and properly, so are the outer finger segments 121 and the arm segment 13. By doing so, the greatest efficiency of the present invention is achieved.

Third, with reference to FIG. 1, except for ensuring the thorough unfolding of the outer webs 22, the supportive function of the finger-supporting boards 31 also increases a web surface of each middle web 21 and the web surface of each outer web 22.

Specifically, when the user wears the present invention, the users' fingers are theoretically as long as the corresponding finger-fit portion 1211. In other words, the extended portion 1212 of each outer finger segment 121 is not designed for accommodating the users' finger, but for providing an extra length to increase the overall length of the outer finger segment 121.

Under the support of the finger-supporting boards 31, the extended portion 1212 may remain in an unfolded structure at any time. So, for each outer web 22, because the two opposite ends of said outer web 22 are respectively connected to an end of the corresponding finger segment 12 and the arm segment 13, if said finger segment 12 is longer, the contact area of said outer web 22 will also increase.

Conclusively, the longer the outer finger segments 12 are, the larger the area of each outer web 22 can be.

Fourth, by the two fixing units 41, the user may fasten the present invention on the users' arm. Therefore even if the user is performing some intense exercise, the present invention will not be easily detached from the users' arm.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A six-webbed glove comprising:

a main body having a palm segment, two opposite ends of the palm segment being respectively a finger end and an arm end;

five finger segments mounted on the finger end of the palm segment, arranged apart from each other along a horizontal direction, communicating with the palm segment, and the five finger segments including three inner finger segments and two outer finger segments; the three inner finger segments disposed between the two outer finger segments;

an arm segment mounted on the arm end of the palm segment, communicating with the palm segment, and having a wearing opening formed on an end of the arm segment away from the palm segment;

four middle webs respectively mounted between every two adjacent said finger segments and each filling up a gap between said two finger segments;

two outer webs respectively mounted on two opposite sides of the main body, and respectively connected to the two outer finger segments; one of two ends of each one of the two outer webs connected to an end of the corresponding outer finger segment, the other end of said outer web connected to a side of the arm segment, and said outer web connected to the corresponding outer forger segment, the palm segment, and the arm segment along a contour of the corresponding side of the main body;

two finger-supporting boards respectively mounted inside the two outer finger segments, each one of the two finger-supporting boards extending to the end of the corresponding outer finger segment;

an arm-supporting board mounted inside the arm segment.

2. The six-webbed glove as claimed in claim 1, wherein each one of the outer finger segments has a finger-fit portion and an extended portion, and two opposite ends of the finger-fit portion are respectively connected to the extended portion and the palm segment;

each of the two finger-supporting boards is mounted in the extended portion of the corresponding outer finger segment, and a length of each one of the two finger-supporting boards is longer than or equal to a length of the corresponding extended portion.

3. The six-webbed glove as claimed in claim 1, wherein a length of each one of the two finger-supporting boards is longer than or equal to a length of the corresponding outer finger segment.

4. The six-webbed glove as claimed in claim 2, wherein a length of each one of the two finger-supporting boards is longer than or equal to a length of the corresponding outer finger segment.

5. The six-webbed glove as claimed in claim 1, wherein the arm-supporting board is arranged apart from the wearing opening;

each one of the outer webs is arranged apart from the wearing opening, and a distance between the arm-supporting board and the wearing opening is shorter than a distance between each one of the two outer webs and the wearing opening.

6. The six-webbed glove as claimed in claim 4, wherein the arm-supporting board is arranged apart from the wearing opening;

each one of the outer webs is arranged apart from the wearing opening, and a distance between the arm-supporting board and the wearing opening is shorter than a distance between each one of the two outer webs and the wearing opening.

7. The six-webbed glove as claimed in claim 1 further comprising at least one fixing unit mounted on the arm segment, and the at least one fixing unit being capable of fastening the arm segment.

8. The six-webbed glove as claimed in claim 6 further comprising at least one fixing unit mounted on the arm segment, and the at least one fixing unit being capable of fastening the arm segment.

9. The six-webbed glove as claimed in claim 7, wherein the at least one fixing unit is each a tying belt.

10. The six-webbed glove as claimed in claim 8, wherein the at least one fixing unit is each a tying belt.

11. The six-webbed glove as claimed in claim 1, wherein the four middle webs and the two outer webs are integrated with each other.

12. The six-webbed glove as claimed in claim 10, wherein the four middle webs and the two outer webs are integrated with each other.

* * * * *